United States Patent [19]

Pearce

[11] 4,104,014

[45] Aug. 1, 1978

[54] PUNCH FOR COMPRESSING MACHINE

[75] Inventor: Arthur R. Pearce, Point Pleasant Beach, N.J.

[73] Assignee: Key Industries, Englishtown, N.J.

[21] Appl. No.: 815,192

[22] Filed: Jul. 13, 1977

[51] Int. Cl.[2] ..... B30B 11/08

[52] U.S. Cl. ..... 425/345; 425/353; 425/354

[58] Field of Search ..... 425/344, 345, 352, 353, 425/354, 355, 78

[56] References Cited

U.S. PATENT DOCUMENTS

| | | | |
|---|---|---|---|
| 1,679,408 | 8/1928 | Davis et al. | 425/78 |
| 2,411,379 | 11/1946 | Langhammer | 425/78 |
| 2,449,008 | 9/1948 | Pecker et al. | 425/78 |
| 3,050,809 | 8/1962 | Kupka | 425/352 |
| 3,332,367 | 7/1967 | Sperry et al. | 425/345 X |
| 3,337,915 | 8/1967 | Alexander | 425/352 |
| 3,408,963 | 11/1968 | Alexander et al. | 425/345 X |
| 3,414,940 | 12/1968 | Vinson | 425/78 |
| 3,647,333 | 3/1972 | Smith | 425/78 |

*Primary Examiner*—J. Howard Flint, Jr.

*Attorney, Agent, or Firm*—Lerner, David, Littenberg & Samuel

[57] ABSTRACT

A tablet-making machine is provided which includes relatively movable upper and lower punches for compressing a charge of material into a tablet. The machine includes a die head having a plurality of die cavities and axially-extending passageways in which the lower punches are mounted for reciprocating movement. Suitable drive means are also provided for controlling the reciprocation of the lower punches within the axial passageways relative to the die head. In accordance with the invention, each of the lower punches is provided with an opening extending completely through the punch and in a direction transverse to the longitudinal axis of the lower punch. Spring-biased plungers are positioned within each of the transverse openings and may be adjusted relative to the lower punches. Means are also provided for adjusting each of the plungers to engage the walls of their respective axial passageways so that the amount of pressure applied by the plungers to the walls of the passageways may be fixed at a predetermined pressure to prevent the lower punches from freely moving relative to the die head.

8 Claims, 3 Drawing Figures

PUNCH FOR COMPRESSING MACHINE

FIELD OF THE INVENTION

The present invention relates generally to compressing machines and specifically to an improved punch for tablet-making machines which includes means for applying transverse pressure between the punches and the die head to prevent undesired movement of the punches relative to the die head.

BACKGROUND OF THE INVENTION

Tablet-making machines typically include relatively movable upper and lower punches for compressing a charge of material into a tablet. The machines usually include a die head having a plurality of die cavities and axially-extending passageways in which the punches are mounted for reciprocation. Typically, the punches are driven by cams which allow for the filling of the material between the punches, compression of the material, and ejection of the formed tablet. However, the means for controlling the reciprocation of the punches, such as the cams, do not always positively control the movement of the punches which results in the formation of tablets having various drawbacks.

For example, when one of the driving cams does not engage the punch, the punch has a tendency to drop downwardly relative to the die head. As a result, excess air is entrapped within the die cavity so that the material to be compressed does not hold together well due to the entrapped air, and the tablet splits. This problem is referred to the art as "capping". In addition, when the punch is being driven to eject the formed tablet, there is also a tendency for the punch to "bounce", "flutter", or "twist" during its movement which may result in the material being impacted more than once, so that it may break the tablet or cause double impressions.

In the prior art, means have been provided for applying pressure between the punches and the die head. Typically, such means include an external restrainer surrounding the die head to engage rods which extend through the die head to apply pressure to the punches. However, the punch pressure inside the die head or socket cannot be precisely adjusted with such an arrangement. Also, because of such lack of adjustment, the punches cannot be adjusted to compensate for wear of the rod tips, sockets, and punches. Another crude method used in the past was to place a spring in a groove around the lower die head. This required special modification of the press, was greasy, and the spring did not maintain constant positive pressure on the punch.

Broadly, it is an object of the present invention to provide an improved punch which overcomes one or more of the aforesaid problems. Specifically, it is within the contemplation of the present invention to provide an improved punch which is constructed to prevent undesired movements of the punches relative to the die head.

It is a further object of the present invention to provide an improved punch which includes means to prevent the punch from dropping upon being disengaged by the machine drive and to also prevent punch "bounce", "flutter", or "twist" during movement of the punches.

It is a still further object of the present invention to provide an improved punch which eliminates the entrapment of excess air during the supplying of material to the die cavity and thereby overcomes the problem of tablet capping.

It is a still further object of the present invention to provide an improved punch in which the punch pressure may be precisely preset and which may be easily adjusted prior to being installed in the die head.

It is a still further object to provide an improved punch which reduces wear on the drive means for the punches and the punch heads due to their positive control and which may be adjusted to compensate for wearing of the machine components.

SUMMARY OF THE INVENTION

Briefly, in accordance with the principles of the present invention, an improved punch is provided for a compressing machine. The compressing machine typically includes relatively movable upper and lower punches for compressing a charge of material into a tablet. The machine further includes a die head having a plurality of die cavities and axially-extending passageways in which the lower punches are mounted for reciprocating movement. Suitable means are also provided for controlling the reciprocation of the lower punches within the passageways relative to the die head.

In accordance with the present invention, each of the lower punches is provided with an opening extending completely therethrough, with the opening extending in a direction transverse to the longitudinal axis of the lower punch. A spring-biased plunger is positioned within each of the transverse openings of the lower punches for adjustment relative thereto. Means are also provided for adjusting each of the plungers to engage the walls of their respective axial passageways so that the amount of pressure applied by the plungers to the walls of the passageways may be fixed at a predetermined pressure to prevent undesired movements of the lower punches relative to the axial passageways.

Advantageously, as a result of the present invention, the load applied by the lower punches to the die head in which they reciprocate may be preset at a precise and exact amount. This is advantageous, since if there is insufficient pressure between the lower punches and die head, then the lower punches will not be positively controlled and will tend to drop, bounce, or flutter. Also, if there is overpressure between the lower punches and the die head, the punch heads and cams will wear faster because of such overpressure. Accordingly, as the lower punches of the present invention may be adjusted and preset with a predetermined load or pressure, these problems are eliminated.

A further advantage of the present invention is that the plungers for the lower punches may be precisely adjusted to compensate for wear on the passageways, the punches, and the tips of the plungers.

A further advantage of the present invention is that it allows presently-employed tablet-making machines to be easily and economically modified to include the plunger or internal restraining means of the present invention, whereas in the prior art, external restrainers were employed, and modification of tablet-making machines to include such external restrainers was expensive and inefficient, as it was required to disassemble the entire tablet-making machine to install such external restrainers. However, in accordance with the present invention, it is only necessary to form transverse openings within the lower punches to include the plungers or internal restrainers and to simply install such lower punches within the die head of the tablet-making machine. As it is no longer necessary to disassemble the entire machine, the use of the modified lower punches of the present invention is efficient and economical.

BRIEF DESCRIPTION OF THE DRAWINGS

Further objects, features, and advantages of the present invention will become apparent upon the consideration of the following detailed description of a presently-preferred embodiment when taken in conjunction with the accompanying drawings, wherein.

DETAILED DISCUSSION OF PREFERRED EMBODIMENT OF THE INVENTION

Figure 1:
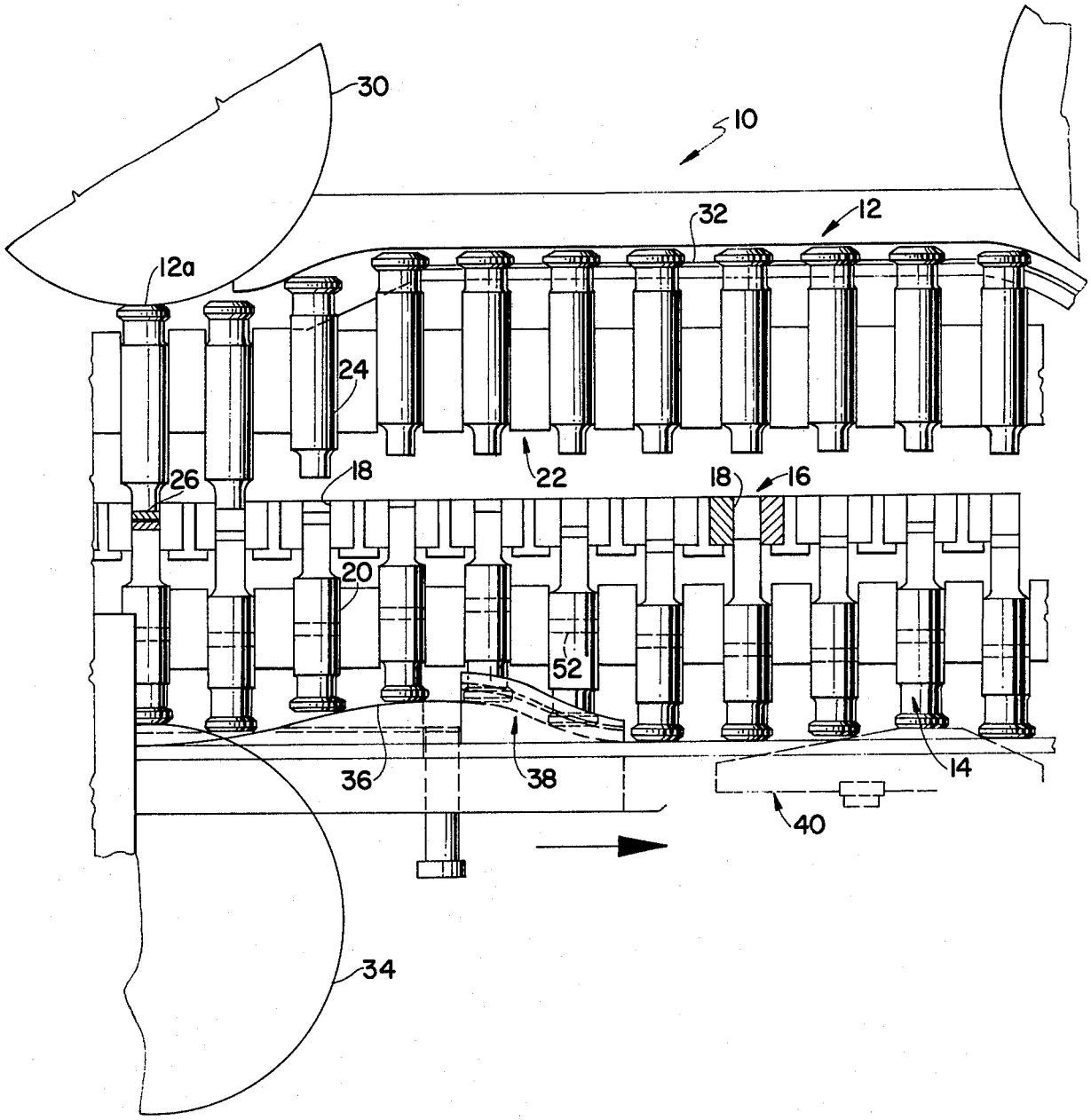
FIG. 1 is an elevational view of a tablet-making machine employing the improved punches of the present invention.
Figure 2:
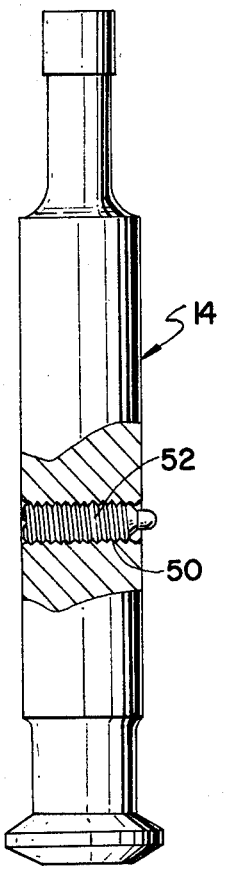
FIG. 2 is a detailed elevational view of a lower punch in accordance with the present invention.

Referring now to FIG. 1, there is shown a rotary tablet-making machine, generally designated by the reference numeral 10, embodying the principles of the present invention. More particularly, the tablet-making machine 10 includes a plurality of upper punches 12 and a plurality of lower punches 14, which are movable relative to each other to compress the charge of material 26 which is to be formed into a tablet. A lower die head 16 is provided having a plurality of die cavities 18 and axially-extending passageways 20 in which the lower punches 14 are mounted for reciprocating movement. Similarly, an upper die head 22 is provided having a plurality of axially-extending passageways 24 in which the upper punches 12 are mounted for reciprocating movement relative to the lower punches 14. As is well known in the art, conventional means are provided for controlling the reciprocating movement of upper and lower punches 12, 14 within the respective passageways 20, 24 relative to the respective die heads 16, 22.

More particularly, upper punches 12 are driven by an upper pressure roll 30 which is adapted to engage punch heads 12*a* and drive them downwardly to compress the charge of material 26 disposed between the upper and lower punches 12, 14. As is also well known in the art, an upper punch cam 32 is provided to control the movement of the upper punches 12 until they are again engaged by the upper pressure roll 30.

Referring now to the lower punches 14, as is also well known in the art, a plurality of cams and a lower pressure roll 34 are provided to control the reciprocating movement of the lower punches 14. Lower pressure roll 34 engages punch heads 14*a* of lower punches 14 and drives them to compress material 26 between the upper and lower punches 12, 14. The cams which drive the lower punches 14 include an ejector cam 36, a pull-down cam 38, and a weight cam 40. As will be seen in the drawings, after lower punches 14 travel off of lower pressure roll 34, they are engaged by ejector cam 36 which operates to eject the formed tablet from die cavity 18. After ejection, the lower punches 14 are engaged by a pull-down cam 38 which operates to pull down lower punches 14 and retract them to their lowermost position, which may be referred to as the "full fill" position. When the lower punches 14 are in this position, the die cavities 18 are overfilled with the charge of material 26. Then, as the lower punches 14 continue to travel, they engage weight cam 40 which has been adjusted to control and determine the proper volume of material required in the die cavity 18 to form the desired tablet. Therefore, weight cam 40 operates to move lower punches 14 slightly upwardly from the full fill position so that excess material 26 is discharged from die cavity 18. As is well known in the art, such excess material is removed by a doctor blade or any other suitable means. In this manner, the proper amount of material 26 is contained within each die cavity 18 and is ready to be compressed by upper and lower punches 12, 14 which are moved into engagement by the upper and lower pressure rolls 30, 34.

In accordance with the present invention, each of the lower punches 14 is provided with an opening 50 which extends completely through and across the lower punches 14. As will be noted, the openings 50 extend in a direction transverse to the longitudinal axis of the lower punches 14. For a purpose to be explained, each opening 50 is internally threaded and is adapted to receive a resiliently-biased plunger 52 which is externally threaded and is adapted to mate with the threads of transverse opening 50. It should be understood that any suitable resiliently-biased plunger 52 may be employed within the transverse opening 50. However, in the preferred embodiment, a Vlier-type spring plunger is employed.

Figure 3:
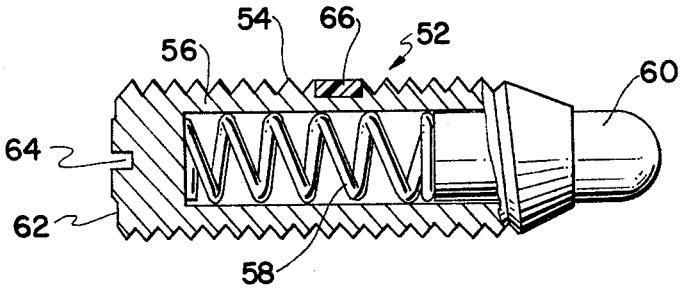
FIG. 3 is a cross-sectional view of a plunger employed in the lower punches.

Referring now to FIG. 3, the details of the Vlier resiliently-biased plunger 52 are clearly illustrated. The plunger 52 includes external threads 54 formed on the external wall of a cylindrically-shaped housing 56. A spring 58 is disposed within housing 56 and at one end engages a nose member 60 and at the other end thereof engages the rear wall 62 of housing 56. As will be noted, nose member 60 is round and may be formed of any suitable material, such as steel, plastic, or nylon. Rear wall 62 includes a slot 64 adapted to receive the tip of a screwdriver for adjusting the position of plunger 52 relative to transverse opening 50. In addition, once the position of plunger 52 is adjusted relative to transverse opening 50, means are provided for preventing movement of plunger 52 relative to the transverse opening 50. In the preferred embodiment, a locking device 66 is provided which is self-locking and eliminates the need for check nuts or other locking devices. As plunger 52 is inserted into transverse opening 50, the locking device 66 is compressed and exerts pressure against the plunger body to prevent the plunger 52 from moving from its preset position within transverse opening 50.

Accordingly, as will be understood, the position of plunger 52 may be adjusted and preset relative to transverse opening 50. Then, each of the lower punches 14 is installed within the axially-extending passageways 20, and in order that the lower punches may be installed, nose member 60 of plunger 52 is biased inwardly against spring 58. Once lower punches 14 are in position, spring 58 exerts an outward pressure on nose member 60 so that it engages the walls of the axial passageways 20. As will be understood, the amount of pressure applied by nose member 60 and plunger 52 to the walls of the passageways 20 may be fixed at a predetermined pressure to prevent undesired movements of the lower punches 14 relative to passageways 20 of die head 16.

In accordance with the present invention, it should also be understood that upper punches 12 may include transverse openings extending completely therethrough, with the openings extending in a direction transverse to the longitudinal axis of the upper punches 12, similar to the transverse openings 50 of lower punches 14. Similarly, resiliently-biased plungers may be positioned within each of the transverse openings of the upper punches for adjustment relative thereto, so that the amount of pressure between the upper punches 12 and the surrounding die head 22 may be fixed at a predetermined pressure to prevent undesired movements of the upper punches 12 relative to the die head 22.

In view of the foregoing, it will be appreciated that as a result of the present invention, the load applied by the punches to the die head in which they reciprocate may be preset at a predetermined and precise amount. As a result, the problem of insufficient pressure between the punches and the die head is eliminated, so that the punches are always positively controlled and will not tend to drop, bounce, or flutter. In addition, the problem of overpressure between the punches and the die head is eliminated so that the punch heads and cams will not wear as fast as when there is such overpressure.

Advantageously, as a result of the present invention, the plungers for the punches may be precisely adjusted to compensate for wear on the passageways, the punches themselves, and the tips of the plungers. Finally, as a result of the present invention, it allows presently-employed tablet-making machines to be easily and economically modified to include the internal restraining means or plunger, and it is no longer required to disassemble the entire tablet-making machine to install restrainers, as in the prior art.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

I claim:

1. A compressing machine, comprising:

relatively movable punches for compressing a charge of material, a die head having a plurality of die cavities and axially-extending passageways in which said punches are mounted for reciprocation, means for controlling the reciprocation of said punches within said passageways relative to said die head, each of said punches having an opening extending completely therethrough, said opening extending in a direction transverse to the longitudinal axis of said punch, a resiliently-biased plunger positioned within each of said transverse openings for adjustment relative thereto, and means for adjusting each of said plungers to engage the walls of their respective axial passageways whereby the amount of pressure applied by said plungers to the walls of said passageways may be fixed at a predetermined pressure to prevent undesired movements of said punches.

2. A compressing machine according to claim 1, wherein said punches include upper and lower punches, each of said upper and lower punches including openings extending completely therethrough, said openings extending in a direction transverse to the longitudinal axis of said upper and lower punches, a resiliently-biased plunger positioned within each of said transverse openings for adjustment relative thereto, and means for adjusting each of said plungers whereby the amount of pressure between said upper punches and the surrounding die head may be fixed at a predetermined pressure to prevent undesired movements of said upper punches.

3. A compressing machine according to claim 1, wherein said adjusting means includes screw threads on said plungers for adjusting the position of said plungers relative to said transverse openings.

4. A compressing machine according to claim 1, wherein said transverse openings and said plungers are threaded for movement relative to each other.

5. A compressing machine according to claim 1, further including means for locking said plungers in position within said transverse openings.

6. A compressing machine according to claim 1, wherein said resilient plunger is of the spring-biased type.

7. A compressing machine according to claim 1, wherein said plunger includes a nose for directly engaging the walls of said axial passageways.

8. A compressing machine according to claim 1, wherein said plunger includes means for adjusting the bias of said plunger relative to said walls.

* * * * *